343/700 MS

United States Patent [19]

Lopez

[11] 4,364,050

[45] Dec. 14, 1982

[54] MICROSTRIP ANTENNA

[75] Inventor: Alfred R. Lopez, Commack, N.Y.

[73] Assignee: Hazeltine Corporation, Greenlawn, N.Y.

[21] Appl. No.: 232,477

[22] Filed: Feb. 9, 1981

[51] Int. Cl.[3] ..... H01Q 1/38

[52] U.S. Cl. ..... 343/700 MS; 343/846

[58] Field of Search ..... 343/700 MS, 846, 854, 343/853, 770

[56] References Cited

U.S. PATENT DOCUMENTS 3,718,935 2/1973 Ranghelli et al. ..... 343/846
4,054,874 10/1977 Oltman, Jr. ..... 343/700 MS
4,242,685 12/1980 Sanford ..... 343/700 MS

*Primary Examiner*—David K. Moore
*Attorney, Agent, or Firm*—E. A. Onders; F. R. Agovino

[57] ABSTRACT

A conductive sheet having slots therein is located between dielectric sheets having microstrip feed networks printed thereon forming a multilayered structure which is spaced from a ground plane by a dielectric substrate and covered by another dielectric substrate having a dielectric skin thereon. The slots comprise an array of horizontal slots perpendicular to vertical slots. One of the dielectric sheets and the microstrip feed network printed thereon is associated with the horizontal slots and the other dielectric sheet and the microstrip feed network printed thereon is associated with the vertical slots.

23 Claims, 5 Drawing Figures

MICROSTRIP ANTENNA

BACKGROUND OF THE INVENTION

1. Field of the Invention

The invention generally relates to microstrip antennas and, in particular, a dual polarized microstrip antenna having radiating cross slots.

2. Description of the Prior Art

A number of designs have been suggested for microstrip antennas that use "wide slots", which are defined as slots having a width which is a significant fraction of a wavelength of the radiated signal. M. Collier suggests, in his September, 1977 article in Microwave Journal (pages 67–71), that both sides of a copper clad board may be etched to provide a slot on one side thereof and a copper strip feeder on the other side thereof. The board may be mounted on pillars at a distance of one-quarter wavelength from a rigid ground plane.

SUMMARY OF THE INVENTION

It is an object of this invention to provide a dual polarized microstrip antenna employing radiating slots.

It is another object of this invention to provide a microstrip antenna employing a slotted conductive sheet in a multilayered configuration between dielectric sheets having microstrip feed networks printed thereon.

The microstrip antenna according to the invention comprises a first dielectric substrate having first and second opposing surfaces. Means for radiating an rf signal, such as a conductive sheet having first and second opposing surfaces and first and second slots with different orientations, such as cross slots, is located adjacent the first dielectric substrate such that the first surface of the radiating means is adjacent the first surface of the dielectric substrate. Means for feeding the first slot with a first signal and for feeding the second slot with a second signal is provided and may comprise first and second microstrip feed networks. A ground plane may be spaced from the means for radiating. A second dielectric substrate having first and second opposing sides may be positioned so that the second surface of the second dielectric substrate is adjacent to the second surface of the means for radiating. The first microstrip feed network having first and second opposing surfaces is positioned so that the second surface of the network is adjacent the second surface of the first dielectric substrate. A second microstrip feed network having first and second opposing surfaces is associated with this structure so that the first surface of the second microstrip feed network is adjacent to the first surface of the second dielectric substrate.

In the cross slot configuration, one network is associated with the horizontal slots of the cross slots and the other network is associated with the vertical slots of the cross slots. Each slot has a first portion and a second portion and each feed network has a feed associated with each portion. Each network further includes means for terminating the feeds into a short circuit. A third dielectric substrate may be located between the first surface of the first microstrip feed network and the ground plane. In addition, another dielectric substrate having a dielectric skin may be located over the second surface of the second microstrip feed network.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
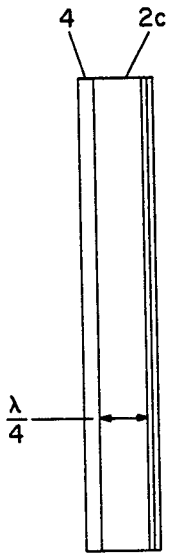
FIG. 1 is a side view of a microstrip antenna according to the invention.
Figure 2:
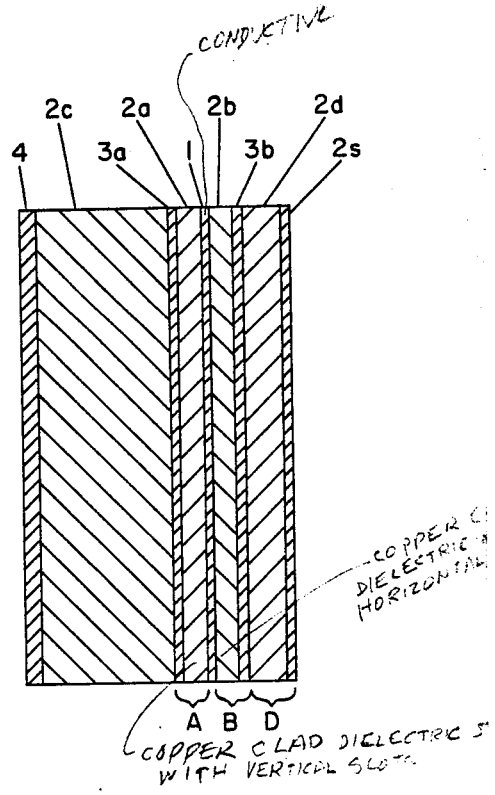
FIG. 2 is a sectional representative view of the multilayered configuration of the microstrip antenna illustrated in FIG. 1.

As illustrated in FIGS. 1 and 2, the microstrip antenna according to the invention is a multilayered configuration including conductive sheet 1 as its means for radiating. The sectional representation of FIG. 2 is an illustration of the layered configuration of the antenna according to the invention. In fact, each layer is not a continuous solid sheet as illustrated. The exact structure of each layer will be apparent from the detailed discussion hereinafter.

Figure 4:
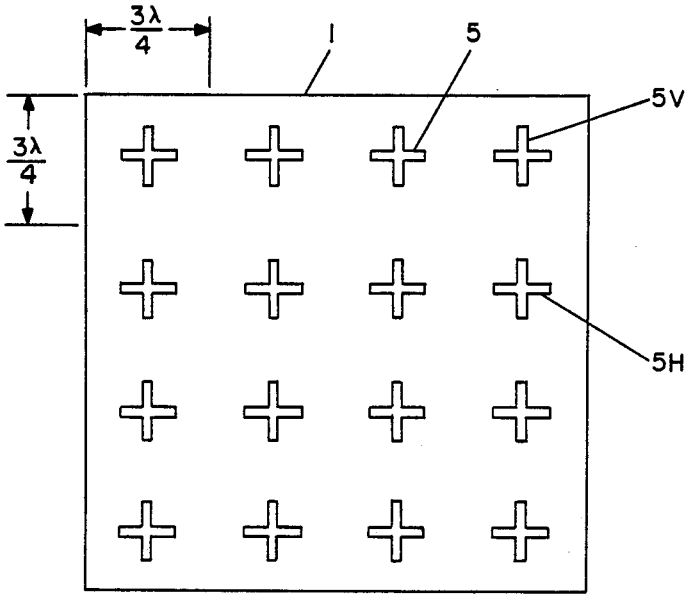
FIG. 4 is a plan view of the radiating conductive sheet having cross slots according to the invention.

FIG. 4 further illustrates a preferred embodiment of the conductive sheet 1, such as a rigid copper substrate comprising a plurality of cross slots 5 having intersecting vertical slots 5V and horizontal slots 5H. Cross slots 5 are arranged in a square configuration with three-quarter wavelength spacing. However, it is contemplated that the conductive sheet 1 may have any array of slots of various orientations, not necessarily intersecting slots, which are spaced by distance related to the wavelength to be transmitted.

The conductive sheet 1 is located between the following substrates: layer A which, in a preferred embodiment, is a copper-clad dielectric sheet having a vertical slot feed network printed thereon for radiating a horizontally polarized signal; and layer B which, in a preferred embodiment, is a copper-clad dielectric sheet with a horizontal slot feed network printed thereon for radiating a vertically polarized signal.

Figure 3:
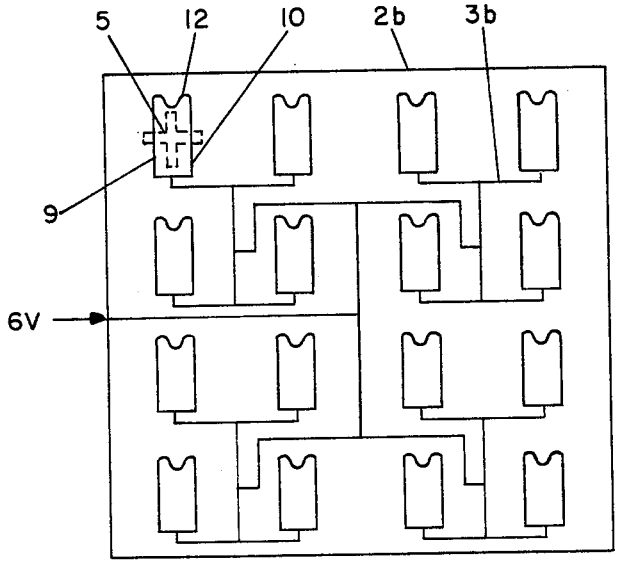
FIG. 3 is a plan view of the horizontal slot microstrip feed network according to the invention.

As illustrated in detail in FIGS. 2 and 3, layer B comprises dielectric substrate **2*b* having a horizontal slot feed network 3*b* printed thereon for providing a signal to be radiated with vertical polarization. In a preferred embodiment, layer B is a copper-clad dielectric sheet which is etched by a printing process to provide the feed network desired. The network 3*b* is provided with independent vertical polarization input port 6V connected by equal line lengths to horizontal slot feeders 9 and 10. In the multilayered configuration according to the invention, horizontal slot feeders 9 and 10 overlay the portions of horizontal slots 5H which project from opposite sides of vertical slot 5V, as indicated in FIG. 3, to feed horizontal slot 5H to radiate a vertically polarized signal. Horizontal slot feeders 9 and 10 are associated with the horizontal slot by means of the 1.5 wavelength microstrip 12 functioning to terminate each feeder into a short circuit. Alternatively, microstrip 12** may be replaced by stubs, such as half-wavelength stubs (not shown), into which each feeder terminates to achieve the short circuit condition.

Figure 5:
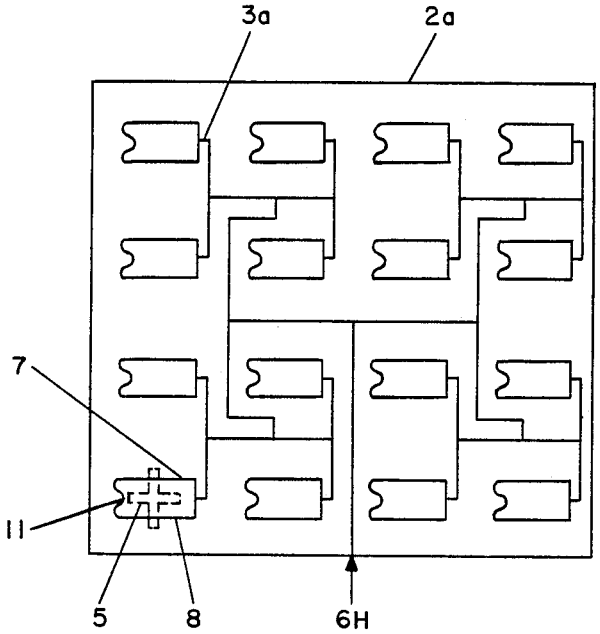
FIG. 5 is a plan view of the vertical slot microstrip feed network according to the invention.

Similarly, layer A comprises dielectric substrate **2*a* having a vertical slot feed network 3*a* printed thereon for providing a signal to be radiated with horizontal polarization. In a preferred embodiment, layer A is a copper-clad dielectric sheet having feed network 3a etched thereon. As illustrated in FIG. 5, the feed network includes independent horizontal polarization input port 6H connected by equal line lengths to vertical slot feeders 7 and 8. In the multilayered configuration, vertical slot feeders 7 and 8 overlay the portions of vertical slots 5V which project from opposite sides of horizontal slot 5H to feed vertical slots 5V to radiate a horizontally polarized signal. Vertical feeders 7 and 8 are associated with the vertical slot by means of the 1.5 wavelength microstrip 11** functioning to terminate each feeder into a short circuit. Alternatively, each feeder may terminate in a half-wavelength stub (not shown).

This multilayered configuration for independently, simultaneously feeding the horizontal slots 5H and the vertical slots 5V of the cross slots 5 provides independent dual polarization diversity. This configuration permits such diversity because the horizontal slots 5H and vertical slots 5V can be separately supplied with signals to be vertically and horizontally polarized, respectively, for independent radiation of the signals. As noted above, slot feeders 7–10 are connected by equal line lengths from inputs 6 so that all slots radiate in-phase and within a selected bandwidth (approximately 10–15%). Furthermore, feeders 7–10 are connected to a 1.5 wavelength stub 11, 12 which functions as a short circuit. In particular, each dual slot feeders 7, 8 and 9, 10 is symmetrically coupled to its associated slot so that the feeders cross at a point where the transmission line characteristic impedance is matched to the slot impedance. This results in decoupling between the vertical slot feeders 7, 8 and the horizontal slots 5H and between the horizontal slot feeders 9, 10 and the vertical slots 5V. The feeders 7–10 are symmetrically coupled to the slots since unsymmetrical coupling to a vertical slot causes coupling to its associated horizontal slot, and visa versa, which is usually not desired. Further, dual slot feeders 7, 8 and 9, 10, being connected by stubs 11, 12 which function as a short circuit, avoid open circuit discontinuities which occur when a single slot feeder with a terminating end portion is employed and further avoid undesired radiation which may occur when the feeders terminate into stubs.

In order to achieve a unidirectional transmission or reception, it is contemplated that the layered structure be provided with a rigid ground plane 4 which may be optimally spaced $\lambda/4$ from the conductor sheet 1 for maximum bandwidth. The ground plane 4 is separated from layer A, and specifically vertical slot feed network 3A, by a dielectric substrate 2C such as foam. In addition, to enhance the weather protection of the antenna, layer B and, specifically, horizontal slot feed network 3B are covered with an additional layer D comprising dielectric substrate 2D and dielectric skin 2S.

Clearly, the symmetrical nature of the antenna according to the invention is not a limitation but rather a preferred embodiment. In addition, it is contemplated that the horizontal slots 5H need not be perpendicular to the vertical slots 5V and that layers A and B may be interchanged in the multilayered structure. Furthermore, the references to horizontal and vertical as used herein are labels referring to perpendicular directions and should not be considered limitations requiring the horizontal slots to be aligned with the horizon or the vertical slots to be aligned with the zenith.

While there have been described what is at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A dual polarized microstrip antenna comprising:

means for radiating an rf signal, said radiating means having first and second opposing surfaces forming first and second intersecting slots having different orientations, said first and second slots forming a plurality of cross slots;

a first dielectric substrate having first and second opposing surfaces, the first surface of said radiating means being adjacent the first surface of said first dielectric substrate;

a second dielectric substrate having first and second opposing surfaces, the second surface of said second dielectric substrate being adjacent the second surface of said means for radiating;

a first microstrip feed network having first and second opposing surfaces, the second surface of said first microstrip feed network associated with said cross slots and being adjacent the second surface of said first dielectric substrate; and a second microstrip feed network associated with said cross slots and having first and second opposing surfaces, the first surface of said second microstrip feed network being adjacent the first surface of said second dielectric substrate.

2. The antenna of claim 1 wherein said means for radiating comprises a conductive sheet.

3. The antenna of claim 1 wherein said first slot is a horizontal slot and said second slot is a vertical slot, perpendicular to said horizontal slot, and wherein said first microstrip feed network is associated with said horizontal slot and said second microstrip feed network is associated with said vertical slot.

4. The antenna of claim 1 wherein said first slot is a horizontal slot and said second slot is a vertical slot perpendicular to said horizontal slot and wherein said first microstrip feed network is associated with said vertical slot and said second microstrip feed network is associated with said horizontal slot.

5. The antenna of claim 1 further comprising a ground plane spaced from the first surface of said first microstrip feed network; and a fourth dielectric substrate having a first surface adjacent the second surface of said second microstrip feed network and an opposing second surface having a dielectric skin juxtapositioned adjacent thereto.

6. The antenna of claim 1 wherein said first microstrip feed network and said first dielectric substrate comprises a dielectric sheet having a microstrip feed network printed thereon.

7. The antenna of claim 1 or 6 wherein said second microstrip feed network and said second dielectric substrate comprises a dielectric sheet having a microstrip feed network printed thereon.

8. A microstrip antenna comprising:

a first dielectric substrate having first and second opposing surfaces;

means for radiating an rf signal, said means having first and second opposing surfaces and first and second slots, the first surface of said radiating means being adjacent the first surface of said first dielectric substrate;

a first microstrip feed network associated with said first slot and having a first port and first and second opposing surfaces, the second surface of said first microstrip feed network being adjacent the second surface of said first dielectric substrate;

a second dielectric substrate having first and second opposing surfaces, the second surface of said second dielectric substrate being adjacent the second surface of said means for radiating; and a second microstrip feed network associated with said second slot and having a first port and first and second opposing surfaces, the first surface of said second microstrip feed network being adjacent the first surface of said second dielectric substrate.

9. The antenna of claim 8 wherein said means for radiating comprises a conductive sheet having at least one cross slot therein, and said cross slot comprises said first and second slots.

10. The antenna of claim 9 wherein each said cross slot comprises a horizontal slot, perpendicular to a vertical slot, and wherein said first microstrip feed network is associated with said horizontal slot and said second microstrip feed network is associated with said vertical slot.

11. The antenna of claim 9 wherein each of said cross slots comprises a horizontal slot, perpendicular to a vertical slot, and wherein said first microstrip feed network is associated with said vertical slot and said second microstrip feed network is associated with said horizontal slot.

12. The antenna of claim 9 further comprising a third dielectric substrate located between the first surface of said first microstrip feed network and a ground plane spaced from the first surface of said first microstrip feed network.

13. The antenna of claim 12 further comprising a fourth dielectric substrate having a first surface with a dielectric skin juxtapositioned adjacent thereto and an opposing second surface adjacent the second surface of said second microstrip feed network.

14. The antenna of claim 9 wherein said first microstrip feed network and said first dielectric substrate comprises a copper-clad dielectric sheet having a microstrip feed network printed thereon.

15. The antenna of claim 9 or 14 wherein said second microstrip feed substrate and said second dielectric substrate comprises a copper-clad dielectric sheet having a microstrip feed network printed thereon.

16. The antenna of claim 8 wherein said first feed network includes a slot feeder associated with said first slot and having a transmission line with a characteristic impedance matched to the slot impedance of said first slot.

17. The antenna of claim 8 wherein said second feed network includes a slot feeder associated with said second slot and having a transmission line with a characteristic impendance matched to the slot impendance of said second slot.

18. The antenna of claim 8 wherein the first slot has a first portion projecting from a side of the second slot and a second portion projecting from another side of the second slot; and wherein said means for feeding comprises a microstrip feed network having a first feed associated with said first portion and a second feed associated with said second portion, said network further including first means for terminating the first feed into a short circuit and second means for terminating the second feed into a short circuit.

19. The antenna of claim 18 wherein said first and second means comprises means for interconnecting the first feed and the second feed.

20. The antenna of claim 19 wherein said means for interconnecting comprises a 1.5 wavelength microstrip.

21. A dual polarized microstrip antenna comprising:

means for radiating an rf signal, said radiating means having first and second opposing surfaces forming first and second intersecting slots having different orientations, said first and second slots forming a plurality of cross-slots, said first slot having a first portion projecting from a side of the second slot and a second portion projecting from another side of the second slot; and means for feeding said first slot with a first signal and for feeding said second slot with a second signal, and means for feeding including a microstrip feed network having a first feed associated with said first portion and a second feed associated with said second portion;

first means for terminating the first feed into a short circuit; and second means for terminating the second feed into a short circuit whereby said first slots radiate a signal having a first polarity and said slots radiate a signal having a second polarity different from said first plurality.

22. The antenna of claim 21 wherein said first and second means comprises means for interconnecting the first feed and the second feed.

23. The antenna of claim 22 wherein said means for interconnecting comprises a 1.5 wavelength microstrip.

* * * * *